United States Patent [19]

Erickson et al.

[11] 4,203,236

[45] May 20, 1980

[54] FOLDABLE SNOW SHOE

[76] Inventors: Alfred C. Erickson, 329 Black Oak Dr., Michigan City, Ind. 46360; Clyde W. Erickson, Box 184, Sperry, Iowa 52650

[21] Appl. No.: 948,039

[22] Filed: Oct. 2, 1978

[51] Int. Cl.[2] ..... A43B 5/04

[52] U.S. Cl. ..... 36/123

[58] Field of Search ..... 36/123, 122, 124, 125

[56] References Cited

U.S. PATENT DOCUMENTS

| | | | |
|---|---|---|---|
| 3,484,958 | 12/1969 | Novak et al. | 36/123 |
| 3,555,707 | 1/1971 | Sharratt et al. | 36/123 |
| 3,636,643 | 1/1972 | Lundquist | 36/123 |

FOREIGN PATENT DOCUMENTS

| | | | |
|---|---|---|---|
| 918698 | 1/1973 | Canada | 36/123 |

*Primary Examiner*—Patrick D. Lawson

*Attorney, Agent, or Firm*—Sixbey, Friedman & Leedom

[57] ABSTRACT

A foldable snow shoe adapted to be manipulated between a folded convenient storage condition and an open and locked use condition with hinge means at the front and rear of the snow shoe to define the foldable condition thereof and associated spreader and stabilizing means to define the open-use condition thereof.

13 Claims, 3 Drawing Figures

FOLDABLE SNOW SHOE

BACKGROUND

Snowshoes are, of course, commonly known in the art and the shoe disclosed herein, in its open, use condition is, in appearance, similar in structure and use to the conventional snow shoe. However, as is well known, conventional snow shoes are large, bulky items and are not convenient to store or to transport when not in use. Accordingly, the use of these articles is limited by reason of their lack of portability. A conventional shoe may extend anywhere from 3 to 5 feet in length from tip to tip and may be as much as 1½ to 2 feet in width. A structure of this size, in addition to being awkward to store and transport is relatively heavy, in pairs, and for this reason also is difficult to transport.

DISCLOSURE

The present invention is directed to the provision of an improved snow shoe structure and specifically is directed to a light, foldable snow shoe that is easy to store and transport.

A foldable, easily transported snow shoe is especially desirable in today's leisure time activities such as cross country skiing and hiking, snowmobiling and other similar activities. It can readily be seen that a conventional, bulky, heavy snow shoe would not be convenient, or desirable, for these activities.

A primary object of the present invention resides in the provision of an improved snow shoe structure which is light, foldable for convenience in storing and portability, easy to use and which is durable in use.

The novel features which are considered to be characteristic of the invention are set forth with particularity in the appended claims. The invention itself, however, together with further objects and advantages thereof will best be understood by reference to the following description taken in connection with the accompanying drawing, in which:

Referring more particularly now to the drawings, the shoe assembly is indicated generally at 10.

Figure 1:
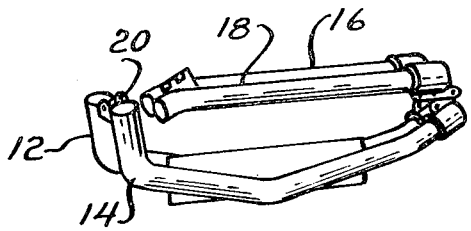
FIG. 1 is a schematic representation of the shoe of the present invention showing the shoe as folded for storage.
Figure 2:
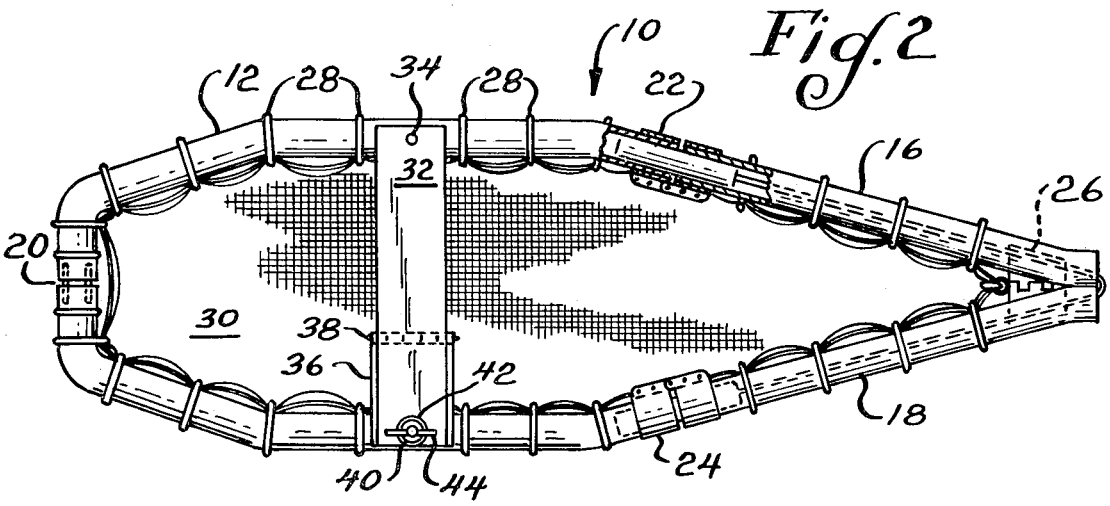
FIG. 2 is a top plan view of the shoe shown in its use position.

The frame of the shoe 10 is defined, in the preferred embodiment, by formed aluminum tube elements 12, 14, 16 and 18, as schematically shown in FIGS. 1 and 2 of the drawings. It should be noted that the frame assembly may be formed of any suitable metal, synthetic or natural material. Aluminum was selected in one form constructed for test purposes because it is a light material having sufficient inherent strength for the purpose. While the shoe may be required to support 200–300 pounds in use it is readily apparent that this load is distributed over a relatively large area and, as such, unusually high strength materials are not required.

The frame members 12 and 14 are joined at the front by a hinge member 20 which permits the frame elements to be moved toward and away from each other. The hinge member 20 may be riveted to the frame members 12 and 14 or joined thereto by any other suitable means.

The other, or rear, end of the frame member 12 is joined to the frame member 16 by another hinge element 22. In the form shown, the hinge element 22 has tubular sections which fit over the mating frame members to join the hinge to the respective frame members with the hinge pivot being externally defined, as illustrated.

The other end of the frame member 14 is joined to the frame member 18 through the hinge member 24, the hinge member 24 being the same as member 22 and providing the same hinge function.

In addition to the above noted hinge elements a rear hinge member 26 may be provided to join the rear terminal portions 17 and 19 of frame members 16 and 18 to provide stability at the rear of the shoe and to define the folding function required to move the frame elements to the folded position schematically represented in FIG. 1. The hinge member 26, as shown, is an abbreviated piano-type hinge for purposes of illustrating the inventive concept herein. It should be noted that a synthetic material may be employed as the hinge element here since this member serves primarily to define a stable rear section of the shoe.

A plurality of rings 28 are slidably positioned over the frame members in spaced apart relation thereon with each of the rings 28 having a section of webbing 30 fastened thereto. It can readily be seen that the rings 28 serve to anchor the webbing 30 to the frame of the shoe 10 and also serve to securely position the webbing 30 with respect to the frame members thereby defining means for further distributing the load on the shoe over a large area to keep the users foot on top of the snow being traversed with the shoes.

A spreader board 32 is pivotally secured at one end thereof to the frame member 12 by the pin 34 thereby defining means for pivotal movement of the board 32 with respect to the frame member 12.

The spreader board 32 is provided with a tensioning member 36 to assemble the board with respect to the frame members and to define means for spreading the frame members in assembled, use condition. The tensioning member 36 is hingedly secured to an inboard portion of the board 32 by the hinge element 38. In assembly of the shoe to its open, use position, a slot (not shown) in the free end of the tensioning member 36 is slipped over the bolt 40, which bolt is securely mounted with respect to the frame member 14 as an assembly member for the shoe. The spreader board 32 then is pressed down to spread the frame members of the shoe assembly and the opening 42 of the board 32 is brought into registration with the bolt 40 of the assembly. The board 32 then is dropped over the bolt and the wing nut 44 is threaded onto the bolt 42 to secure the assembly in its open, use condition.

The distance between the inboard terminal of the slot in the free end of the tensioning member 36 and the hinge 38 thereof is slightly less than the distance between the opening 42 and the hinge member 38 thereby requiring slight tension of the spreader board on the frame members to bring the openings 42 into registration with the bolt 40 defining means to securely anchoring the assembly in its use condition.

Figure 3:
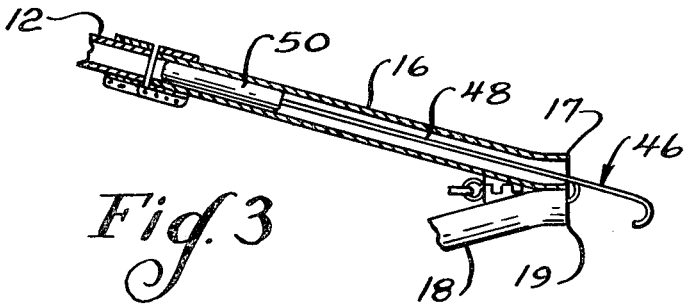
FIG. 3 is a fragmentary view showing the hinge locking and stabilizing means associated with the shoe structure.

The shoe 10, in assembled relation, is further stabilized by use of the push rod and stabilizer plug assemblies 46. As seen in FIGS. 2 and 3 of the drawings, the stabilizer assemblies 46 include a push rod 48 and stabilizer plug 50. In assembled condition the stabilizer assemblies are moved inwardly so that the plug 50 is positioned in the hinge areas 22 and 24 between frame ends 12 and 16, and frame ends 14 and 18, respectively. This plug 50, when inserted in the area noted, will freeze the hinges 22 and 24 in open, use condition thereby preventing the frame members 16 and 18 from moving about the hinge elements 22 and 24 in use of the shoes.

It should be noted that in actual use of the foldable shoe the push rods 48 and plug elements 50 are inserted first into the hinge joints of hinges 22 and 24 and then the spreader board is moved into position as described herein. In spread position the sections 12 and 14 are moved into tight frictional engagement with the plug elements 50 to securely capture the plug elements in locking position thereby preventing inadvertent release.

When the shoes are to be folded, the stabilizer assemblies 46 are moved to withdraw the plugs 50 from the hinge areas thereby permitting the frame member elements 16 and 18 to be folded about the hinges 22 and 24, respectively.

Folding of the shoes is accomplished by removing the plug elements 50 from the hinge areas as noted above. Then the wing nut 44 is removed from the bolt 40 and the spreader board is withdrawn from the bolt. These two simple actions serve to free the shoes for folding, as required. The frame members 12 and 14 are folded about the hinge element 20 and the frame members 16 and 18 are folded about the hinge elements 22 and 24, respectively, thereby bringing the shoes to the folded position schematically represented in FIG. 1 of the drawings. The spreader board 32 is pivoted about the pin 34 to bring it into the folded area of the frame members for convenience in storage of the shoe in its folded condition.

The terminal portions 17 and 19 of the frame members 16 and 18, respectively, are slightly curved to prevent accidental withdrawal of the stabilizer plugs 50 from the frame members.

While a specific embodiment of the present invention is shown and described it will, of course, be understood that other modifications and alternative constructions may be used without departing from the true spirit and scope of this invention. It is intended therefore by the appended claims to cover all such modifications and alternative constructions as fall within their true spirit and scope.

We claim:

1. A snowshoe including
(a) a showshoe frame;
(b) webbing secured to said frame to provide a supporting surface;
(c) a first set of joint means attached to said snowshoe frame at longitudinally opposite ends thereof to allow said snowshoe frame to fold about its longitudinal axis; and
(d) a second set of joint means attached to said snowshoe frame at transversely opposite points thereof to allow said snowshoe frame to fold about a transverse axis passing therethrough.

2. A snowshoe as set forth in claim 1, wherein a spreader bar means is attached to said snowshoe frame and is positioned between transverse sections of said frame, said spreader bar means operating to releasably lock said snowshoe frame in an unfolded position relative to said longitudinal axis.

3. A snowshoe as set forth in claim 1, wherein stablizing means contained within said snowshoe frame operate to releasably lock said snowshoe frame in an unfolded position relative to said transverse axis.

4. A snowshoe as set forth in claim 2, wherein said spreader bar means includes an elongated board member, one end of which is pivotably attached to said snowshoe frame and the other end of which contains a cavity for receiving a projecting fastner means secured to a portion of said snowshoe frame at a point transversely opposite the point of pivotable attachment of said elongated board member.

5. A snowshoe as set forth in claim 4, wherein an elongated tensioning means has one end pivotally fastened to said elongated board member at a point intermediate the ends of said elongated board member to provide additional leverage in locking said snowshoe frame in an unfolded position.

6. The foldable snow shoe of claim 1, wherein the frame is formed by hollow, formed tubing elements.

7. A snowshoe as set forth in claim 6, wherein said showshoe frame includes first and second hollow formed tubing elements positioned on one side of said longitudinal axis and third and fourth hollow formed tubing elements positioned on the other side of said longitudinal axis.

8. A snowshoe as set forth in claim 7, wherein said second set of joint means includes a first hinge element for joining adjacent ends of said first and second hollow formed tubing elements and a second hinge element for joining adjacent ends of said third and fourth hollow formed tubing elements.

9. A snowshoe as set forth in claim 8 including a stabilizing means having a first plug means movable within said first and second hollow formed tubing elements to rigidly secure said hollow formed tubing elements relative to said first hinge element, and also having a second plug means movable within said third and fourth hollow formed tubing elements to rigidly secure said hollow formed tubing elements relative to said second hinge element.

10. A snowshoe as set forth in claim 9, wherein first and second pushrod means are respectively attached to said first and second plug means and extend respectively through and beyond the rear terminii of the two hollow formed tubing elements adjacent the rear longitudinal joint means attached to said snowshoe frame, said first and second pushrod means operating to cause respective moemvent of said first and second plug means into and out of simultaneous engagement with the hollow formed tubing elements respectively joined by said first and said second hinge elements.

11. A showshoe as set forth in claim 10, wherein the terminal portions of the hollow formed tubing elements adjacent the rear longitudinal joint means attached to said snowshoe frame are curved outwardly to prevent accidental withdrawal of said first and second plug means from the hollow formed tubing elements.

12. A snowshoe as set forth in claim 1, wherein said first and said second sets of joint means are attached to said snowshoe frame in a manner such that the frame must be folded about its longitudinal axis prior to being folded about a transverse axis.

13. A snowshoe including:
(a) a snowshoe frame with hinge means attached to said frame at longitudinally opposite ends thereof, said hinge means operating to allow said snowshoe frame to fold about its longitudinal axis, and
(b) a spreader bar means attached to said snowshoe frame and positionable between transverse sections of said frame, said spreader bar means operating to releasably lock said snowshoe frame in an unfolded position relative to said longitudinal axis.

* * * * *